US005564197A

United States Patent [19]

Kade et al.

[11] Patent Number: 5,564,197

[45] **Date of Patent: *Oct. 15, 1996**

[54] DRY END WITH OPEN REVERSAL PLACE

[75] Inventors: Werner Kade, Neenah, Wis.; Wilfried Kraft; Wolfgang Mayer, both of Heidenheim, Germany

[73] Assignee: J. M. Voith GmbH, Germany

[ * ] Notice: The term of this patent shall not extend beyond the expiration date of Pat. No. 5,321,899.

[21] Appl. No.: 222,841

[22] Filed: Apr. 5, 1994

Related U.S. Application Data

[63] Continuation-in-part of Ser. No. 867,411, Apr. 13, 1992, Pat. No. 5,321,899.

[51] Int. Cl.[6] ..... F26B 11/02

[52] U.S. Cl. ..... 34/114; 34/116

[58] Field of Search ..... 34/114, 115, 116, 34/117, 118, 119, 120, 121

[56] References Cited

U.S. PATENT DOCUMENTS

| | | | |
|---|---|---|---|
| 3,237,316 | 3/1966 | Sachs | 34/114 |
| 4,934,067 | 6/1990 | Wedel | 34/116 |
| 5,101,577 | 4/1992 | Wedel | 34/114 |
| 5,144,758 | 9/1992 | Skaugen et al. | 34/117 |
| 5,146,696 | 9/1992 | Mayer et al. | 34/116 |
| 5,205,052 | 4/1993 | Kraft et al. | 34/116 |
| 5,299,363 | 4/1994 | Kraft et al. | 34/117 |
| 5,321,899 | 6/1994 | Kade et al. | 34/114 |
| 5,404,653 | 4/1995 | Skaugen et al. | 34/114 |

FOREIGN PATENT DOCUMENTS

| | | |
|---|---|---|
| 8804206 | 6/1988 | WIPO . |

*Primary Examiner*—John T. Kwon

*Attorney, Agent, or Firm*—Ostrolenk, Faber, Gerb & Soffen, LLP

[57] ABSTRACT

The dry end of a paper machine comprises a first dryer group with top drying cylinders, with a first drying wire and with bottom deflection suction rolls. Adjacent this, there is a second dryer group with bottom drying cylinders, with a second drying screen and with top deflection suction rolls. In this way, both sides of the web to be dried come, in succession, into direct contact with the drying cylinders. At the place where the web changes from the first drying wire to the second drying wire, there is a transfer suction roll which lies within the loop of the second support belt. The web travels there from the last cylinder of the first dryer group over an at least approximately straight travel path to the transfer suction roll and thus onto the second support belt.

27 Claims, 2 Drawing Sheets

DRY END WITH OPEN REVERSAL PLACE

CROSS REFERENCE TO RELATED APPLICATION

This is a continuation-in-part of Ser. No. 07/867,411, filed Apr. 13, 1992, now allowed.

BACKGROUND OF THE INVENTION

1. Field of the Invention

The present invention relates to a dry end of a machine for the manufacture of a fiber web, particularly a paper web, and particularly to a dry end having an open reversal place which improves the web transfer from a first dryer group to a second dryer group.

2. Description of Related Art

Reference is made to the following publications:

In accordance with U.S. Ser. No. 07/825,395, filed Jan. 24, 1992, now U.S. Pat. No. 5,299,363, issued Apr. 5, 1994, the web travels on a meandering path from the last cylinder of the first dryer group, initially together with the first support belt and then with the second support belt, to the first cylinder of the second dryer group. For this, two reversal suction rolls are required, each of which must have a very large suction zone; the suction zone must extend over more than half of the circumference of the roll. The amount of air to be drawn off is therefore relatively high. Furthermore, the arrangement requires a relatively large amount of space and therefore a relatively large horizontal distance between the two drying groups.

According to U.S. Pat. No. 5,101,577, an at least approximately linear path of travel from the last cylinder of the first dryer group to the first cylinder of the second dryer group is provided for the web which is to be dried. Since, however, the two support belts cover one another at the place where the web shifts from one support belt to the other, a relatively large distance is again required between the two drying groups. In accordance with FIG. 6 of U.S. Pat. No. 5,101,577, a space is provided between the two support belts which cover one another so that the web is transferred over a free travel path, i.e. without support, from one support belt to the other. In this regard, it is stated that the space makes it possible for the second support belt to travel at a higher speed than the first support belt so that the web is maintained under tension.

EP 0334899-B1 (WO 88/04206), published Jun. 16, 1988, discloses cylinder configurations of background interest, for example at the right-hand ends of FIGS. 1 and 2.

U.S. Pat. No. 5,144,758 is also of background interest.

The disclosures of all prior art materials mentioned herein are expressly incorporated by reference.

SUMMARY OF THE INVENTION

An important feature of the present invention is to develop the above-mentioned dry end in such a manner as to simplify the path of travel of the web in the region of the place of separation, such that the path has as few deflections as possible. In the disclosed configuration, the place of separation is developed as a reversal place, such that one face of the web contacts the cylinders in the first dryer group and the other face of the web contacts the cylinders in the second dryer group. Nevertheless, the distance between the drying cylinders at the place of separation is as small as possible, enabling the dry end to have a smaller total length than dry ends that were previously known.

In one disclosed example of the invention, a so-called transfer roll is provided at the place of separation and within the loop of the second support belt. The transfer roll is a guide roll for the second support belt, and the web forms with the transfer roll only a small angle of wrap of preferably 10° to 50° (in rare exceptional cases up to a maximum of 90°).

One important feature of the transfer roll is that its cylindrical surface has recesses, for instance holes, preferably continuous holes or circumferential grooves. In this way, it is able to absorb a stream of air which arrives with the web, so that the web together with the second support belt travels without problems (and, in particular, without the formation of a bubble) to the first drying cylinder of the following dryer group. This advantage is of particular importance in paper making machines which operate with high speed in the range of 1500 m/min.

The transfer roll is preferably developed as a suction roll. Due to the above-mentioned small angle of wrap, the transfer suction roll requires only a relatively small suction zone. It will therefore, as a rule, be provided with an internal stationary suction box having longitudinal sealing strips which are arranged in accordance with the relatively small suction zone desired. Thus, relatively little air need be drawn off in order to produce the vacuum in the suction zone.

The transfer roll is, in many cases, the only roll which need be arranged at the place of separation directly between the two adjacent drying cylinders. Therefore, these two drying cylinders can be arranged at a relatively small distance from each other. If, at the same time, a certain difference in height is provided, between the adjacent drying cylinders, a considerable reduction in the horizontal distance can be obtained. Accordingly, the overall structural length of the dry end is reduced, particularly if there are several places of separation of the type described.

Another advantage of the arrangement in accordance with the invention is that—as is frequently necessary—a free, i.e. unsupported, travel path can be provided at the place of separation for the web which is to be dried. In this case, one speaks of an "open place of separation" or "open draw". The path of free travel terminates at the circumference of the transfer roll, preferably in the region of the suction zone, if a suction transfer roll is provided. If, at the same time, the first support belt of the first dryer group, by means of a guide roll (lying within the loop of the support belt), supports the web up to the start of the free travel path, then the beginning and end of the free travel path are unambiguously defined. As a result, the web passes quietly and dependably over the free travel path, even when the web travels with extremely high speed (this in contradistinction to the arrangement in accordance with U.S. Pat. No. 5,101,577, FIG. 6).

The above-described free travel path of the web can be used as follows: If the open place of separation is located in the initial region of the dry end, the following dryer group can be driven with a slightly higher speed than the preceding dryer group. In this way, the still relatively wet web which is increasing in length (as a result of increase in temperature) can be held cautiously under a certain tensile stress. If, on the other hand, the open place of separation is located in the end region of the dry end, then the following dryer group can be driven with a slightly lower speed than the preceding dryer group. In this way, the fact can be taken into account that the web shrinks longitudinally, i.e., in the direction of web travel, as its moisture content becomes less. In this way, longitudinal stresses resulting therefrom can be reduced.

Thus, the danger of the web tearing in the end region of the dry end as a result of possible longitudinal stresses is counteracted. This danger will be greater the more one wishes to dry the web, and therefore, the smaller the remaining residual moisture content is to be. Due to the negative difference in speed described, it will therefore be possible to dry the web more strongly than heretofore. With some types of paper, this facilitates further processing, for instance in a coater or in a glazing calender.

The invention therefore relates to a dry end which has at least two single-row dryer groups and in which the first side of the web comes into contact with the cylinders of a "first" or "preceding" dryer group and the second side of the web with the cylinders of a "second" or "further" dryer group. In other words, the so-called separation place where the web transfers from one dryer group to the other is a reversal place.

Two dryer groups of this type can be arranged in the initial region of a dry end, where, therefore, the web to be dried is still relatively wet. It is entirely possible for a large number of dryer groups to be arranged one behind the other, each with a reversal place between two adjacent dryer groups. If necessary, the entire dry end of a paper manufacturing machine can be divided into dryer groups in such a manner that all separation places are developed as reversal places.

However, it is also possible to provide, for instance, two or three dryer groups—with places of reversal therebetween—only in the end region of the dry end. In such case, several dryer groups are connected one behind the other in the initial region of the dry end, and all of the cylinders of these initial groups come into contact only with the bottom side of the web.

Further features and advantages of the invention and of the developments disclosed and claimed herein will be explained in the following detailed description of two embodiments of the invention, with reference to the drawings.

DETAILED DESCRIPTION

Figure 1:
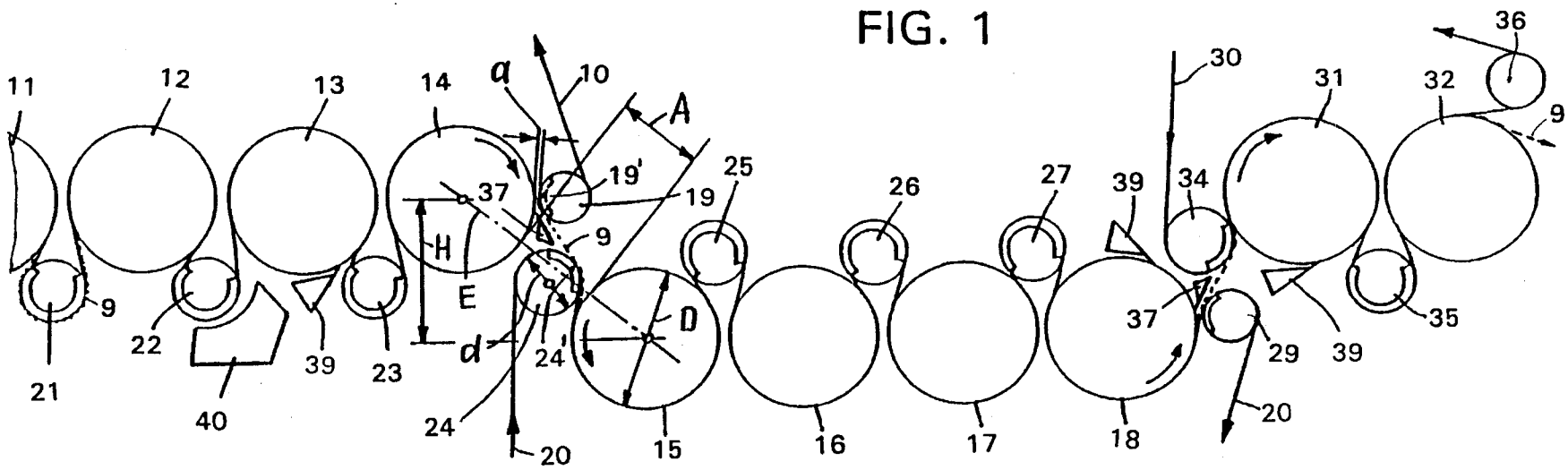
FIGS. 1 is a diagrammatic side view of part of a dry end, which is part of a paper manufacturing machine, according to a first embodiment of the invention.
Figure 2:
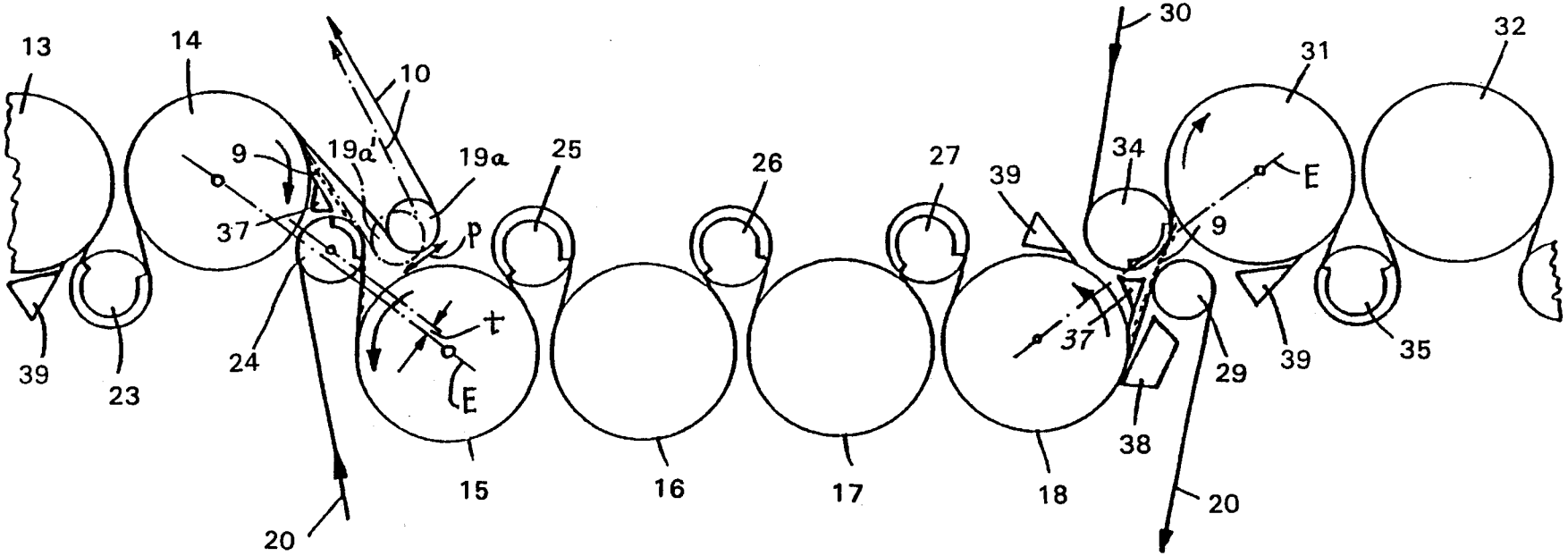
FIG. 2 is a diagrammatic side view of part of a dry end according to a second embodiment of the invention.

In both FIGS. 1 and 2, the paper web 9 to be dried (shown in part as a dotted line) travels from left to right through the dry end. A "first" (or "preceding") dryer group comprises, for instance, four top heatable drying cylinders 11 to 14 and three bottom reversing rolls 21 to 23. The reversing rolls may be grooved rolls; preferably they are suction rolls and in the following they are designated "deflection suction rolls". The "first" dryer group may be positioned directly behind the press section of the paper making machine, i.e., in the initial region of the dry end, or in the middle or end region of the dry end.

A first endless porous support belt 10, which is preferably developed as a drying wire, travels in meander form alternately over the drying cylinders and the deflection suction rolls and, behind or following the last drying cylinder 14, over a guide roll 19 and back to the beginning of the first dryer group. The paper web 9 is continuously conducted by the support belt 10 from the first drying cylinder 11 to the guide roll 19, the lower side of the paper being in direct contact with the drying cylinders. The guide roll 19 optionally may have a suction zone 19', as discussed further below. The deflection suction rolls 21 to 23 are provided with perforated walls so that the paper web 9 is held fast by vacuum against the support belt in the region of these deflection suction rolls.

Deflection suction rolls are shown symbolically with inner stationary suction boxes. Instead of this, known boxless suction rolls can also be used.

An asymmetric arrangement of the deflection suction rolls between the adjacent cylinders is shown. There is namely a very small distance between each deflection suction roll and the preceding cylinder and a larger distance between the deflection suction roll and the following cylinder. However, a symmetrical arrangement is also possible.

A "second" (or "following") dryer group is arranged directly following the first or preceding dryer group. It comprises, for instance, four bottom drying cylinders 15 to 18 and three top deflection suction rolls 25 to 27. A second support belt 20 travels through this dryer group, first over a so-called transfer suction roll 24 which is arranged directly in front of the first drying cylinder 15. More precisely, the transfer suction roll 24 lies between the last drying cylinder 14 of the first dryer group and the first drying cylinder 15 of the second dryer group. As shown in FIG. 1, the paper web 9 moves over a free travel path from the first support belt 10 to the second support belt 20. The free travel path commences at the circumference of the guide roll 19 and ends in the region of the suction zone 24' on the circumference of the transfer suction roll 24. In the second dryer group, the upper side of the paper comes into contact with the drying cylinders 15 to 18.

From FIG. 1 it can be noted that the paper web 9 wraps around the transfer suction roll 24 only over a small part of its circumference. An angle of wrap of, for instance, 10° to 50° is preferred. It is namely desired to obtain the result that the paper web 9 is deflected as little as possible on its path between the cylinders 14 and 15. This facilitates the threading of the paper web into the dry end (upon the starting of the paper machine or after a tear in the paper web), and in particular the transfer of the tip of the edge strip of the paper web which, in known manner, first passes through the dry end. In this connection, a band carrier is not necessary, in contradistinction to older arrangements.

The place of separation between the two dryer groups 11 to 14 and 15 to 18, which place is open as described above (and developed as a reversal place), is furthermore characterized by the fact that—in particular between the last cylinder 14 of the first dryer group and the transfer suction roll 24—an at least approximately straight path of travel is provided for the paper web 9. In other words, the guide roll 19 which lies behind the cylinder 14 is wrapped over only a very small angle by the paper web 9, which angle may be between 0° and 30°, preferably at most about 15°. The axis of the transfer suction roll 24 is located, as shown in FIG. 1, close to a plane E which is determined by the axes of the two adjacent drying cylinders 14 and 15. In FIG. 1, the axis of the transfer suction roll 24 lies somewhat below the plane E. The axis can, however, also lie precisely at this plane E or, by way of exception, somewhat above it. In such exceptional case, the paper web 9 would wrap the transfer suction roll over a somewhat larger angle. However, this angle should not exceed 90°.

Figure 3:
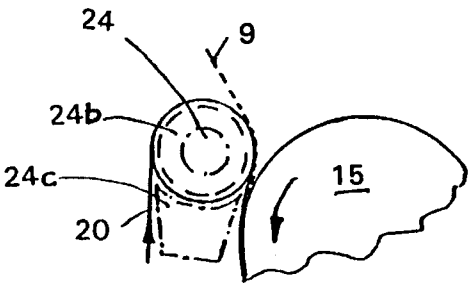
FIG. 3 shows a transfer roll according to a modification of FIG. 1.

In accordance with the diagrammatic view in FIG. 1, the transfer suction roll 24 has a perforated roll shell and an internal suction box which defines the suction zone 24'. Differing from this, in accordance with FIG. 3, other known constructions for a transfer roll **24*b* can also be provided. For instance, the shell of the roll, which is symbolically represented by a dash-line circle, may have circumferential grooves and/or holes. In the latter case, continuous holes are preferred since an oncoming stream of air can escape inward. A roll shell provided with circumferential grooves can, if necessary, be combined with a known external suction box 24*c*. If the roll shell is perforated, air can, if necessary, be drawn off through a hollow journal 24*d***.

In accordance with FIG. 1, the drying cylinders 11 to 14 and 15 to 18 are arranged in horizontal rows. The cylinders 11 to 14 of the first dryer group lie a difference in height H above the cylinders 15 to 18 of the second dryer group. The difference in height H is approximately equal to, or preferably 80% to 120% of, the cylinder diameter D. The clear distance A, measured in the plane E, between the two adjacent drying cylinders 14 and 15, is approximately one-half, preferably about 55%, of a cylinder diameter D. By the largest possible difference in height H and the smallest possible spacing A, the greatest possible reduction in the total structural length of the dry end is obtained. Preferably, therefore, the diameter d of the transfer suction roll 24 is selected as small as possible; furthermore, the clear distance A between the two drying cylinders 14 and 15 is only slightly greater, at most about 40% greater, than the roll diameter d. In this connection, it is advantageous, in particular, to keep the distance between the transfer suction roll 24 and the following drying cylinder 15 as small as possible. This also contributes to dependable guidance of the paper web 9.

Differing from FIG. 1, it is also possible to arrange all rows of cylinders at the same height (in accordance with Federal Republic of Germany P 40 37 423.8 =U.S. Pat. No. 5,146,696), namely when a somewhat larger overall structural length of the dry end can be tolerated.

The guide roll 19 can be developed as a simple, smooth roll. Differing from this, it can however also be developed as a suction roll with a small suction zone 19' (represented diagrammatically by dash lines). This suction zone is arranged at the place where the paper web 9 and the support belt 10 move off from the drying cylinder 14. In order to provide assurance that the paper web, as far as possible, travels together with the support belt at this run-off point, the guide roll 19 is arranged at a very small distance a, preferably between 5 and 50 mm, from the circumference of the cylinder 14. For this same purpose, a stationary suction device 38 can be provided at that run-off point, as shown in FIG. 2 at cylinder 18. That suction device may be, for instance, in the form of a known web stabilizer. In both variants, it is favorable to provide a narrow scraper 37 in the region of the operator-side edge of the paper web directly behind the point where the web runs off from the last cylinder 14 of the first dryer group. This scraper serves (upon the threading of the paper web into the dry end) for detaching the oncoming tip of the edge strip of the paper web from the cylinder 14. This scraper 37 can be provided with a blast device which conducts the edge strip to the transfer suction roll 24.

In FIG. 1 there is also shown a third dryer group following directly after the second dryer group. Here, the second dryer group is the preceding one and the third dryer group is the following one. The third dryer group comprises two top drying cylinders 31 and 32, a transfer suction roll 34, a deflection suction roll 35, and a normal guide roll 36 arranged behind the last cylinder 32. It is assumed that this dryer group 31, 32 is the last dryer group of a dry end from which the completely dried paper web 9 travels to a subsequent station, which is not shown in the drawing (for instance, a calender, reel, size press, coater or the like). The place of separation between the cylinders 18 and 31 is again developed as an open place of separation, corresponding to the place of separation described above between the cylinders 14 and 15.

In FIG. 2, with solid lines, the place of separation between the cylinders 14 and 15 is shown as it is during normal operation. It is again developed as an open place of separation. The web 9 travels in a free web draw from cylinder 14 over a linear travel path up to the transfer suction roll **24*a*. From there the web travels further together with the second support belt 20 to the first drying cylinder 15 of the second dryer group. A normal belt guide roll 19*a* is placed at the position shown with solid lines in FIG. 2 such that belt 10 traveling from cylinder 14 to guide roll 19*a* diverges from web 9 (or, forms with web 9** a small angle of divergence of between 2° and 30°).

In FIG. 2, the axis of the transfer roll **24*a*** is above plane E. However, as mentioned above, that axis may also be at or below plane E.

Guide roll **19*a* may be shiftable during operation between the two positions 19*a* and 19*a*', see twin-arrow P in FIG. 2. Position 19*a*' may be selected for the threading of the paper web into the dry end. That position 19*a*' is shown in dot-dash-lines, with belt 10 traveling with web 9 from cylinder 14 to transfer suction roll 24*a***.

The second dryer group of FIG. 2 is followed by a third dryer group 30 to 35, shown only in part, the place of separation being developed as an open place of separation in the same way as in FIG. 1.

Figure 4:
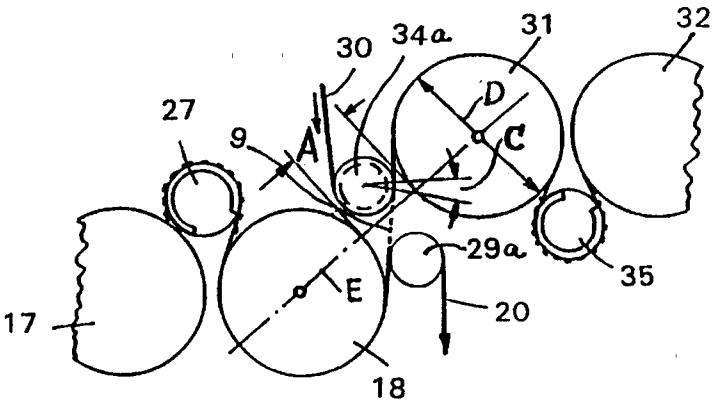
FIG. 4 shows a further alternative to FIGS. 1 and 2.

An alternative thereof is shown in FIG. 4. Therein, a transfer roll **34*a*, having a smooth or (as shown) a grooved roll shell, is placed upstream of the first cylinder 31 of the third dryer group. Transfer roll 34*a* is also a belt guide roll for support belt 30. In addition, a belt guide roll 29*a*, having a smooth (as shown) or a grooved roll shell, is placed downstream of the last cylinder 18 of the second dryer group. Preferably, roll 29*a* is smooth and roll 34*a* is grooved. The travel path of web 9 is almost tangential to the cylinders 18 and 31. In other words, web 9 forms on rolls 29*a* and 34*a* only very small wrap angles. On roll 29*a*, the wrap angle is almost zero. On roll 34*a*, the wrap angle is at most 30°, as an example (see angle designated c). If it is desired to arrange a tail cutter (not shown) between rolls 29*a* and 34*a*, the free web draw between these rolls is relatively long. Otherwise that free web draw may be made shorter (by shifting at least one of rolls 29*a* and 34*a* ). In FIG. 4, the clear distance A, measured in the plane E, between the two adjacent drying cylinder 18 and 31**, is about 45% of a cylinder diameter D.

In all embodiments of the invention, in addition to the aforementioned narrow edge-strip scrapers 37, there is preferably provided, at least on a part of the drying cylinders, a scraper 39 which extends over the entire width of the web. A known hot air blast box 40 can be provided on each deflection suction roll, as shown by way of example on the deflection suction roll 22 in FIG. 1.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dry end of a machine for the manufacture of a fiber web, in particular a paper web, having the following features:

a) the dry end comprises a first plurality of heatable drying cylinders which form a preceding dryer group and rotate in one direction of rotation, and a second plurality of heatable drying cylinders which form a following dryer group and rotate in another direction of rotation, a reversing roll being arranged between every two drying cylinders;

b) the preceding dryer group has a first porous endless support belt forming a loop, and the following dryer group has a second porous endless Support belt forming a loop, and the fiber web travels in each dryer group together with the respective support belt alternately over the drying cylinders and the reversing rolls so that the fiber web comes into direct contact with the drying cylinders, and the support belt comes into direct contact with the reversing rolls;

c) in the preceding dryer group, a first side of the web comes into contact with the cylinders and a second side of the web comes into contact with the first porous endless support belt;

d) in the following dryer group, which immediately follows the preceding dryer group, the second side of the web comes into contact with the drying cylinders and the first side of the web with the second porous endless support belt;

e) between the two dryer groups there is a transfer roll lying within the loop of the second support belt and guiding the same; and f) the web travels from the first to the second support belt on a free unsupported web draw terminating at the circumference of the transfer roll; and g) the web wraps around the transfer roll over an angle of at most 90° and travels together with the second belt on a straight path from the transfer roll to a first cylinder of the following dryer group; and characterized by the fact that the transfer roll has a shell which is provided with openings selected from the group consisting of circumferential grooves, blind holes, and continuous holes.

2. A dry end according to claim 1, characterized by the fact that the web follows a straight path of travel from a last cylinder of the preceding dryer group to the transfer roll.

3. A dry end according to claim 2, wherein the support belt of the preceding dryer group travels over a straight path, which diverges from the web travel path, from the last cylinder to a belt guide roll arranged in the loop of said support belt.

4. A dry end according to claim 3, wherein a diverging angle between the straight path of the support belt and the straight path of the web is between 2° and 30°.

5. A dry end according to claim 1, characterized by the fact that a guide roll lying within the loop of the first support belt of the first dryer group contacts a path of travel of the web from a last cylinder of the preceding dryer group to the transfer roll.

6. A dry end according to claim 5, characterized by the fact that the web wraps around said guide roll over an angle of about 0° to 30°.

7. A dry end according to claim 6, wherein the web wraps around the guide roll over an angle of at most about 15°.

8. A dry end according to any one of claims 5 to 7, characterized by the fact that said guide roll lies at a distance a from the last cylinder of the preceding dryer group and has a suction zone in the region of the web run-off point from said cylinder, with the distance a being between 5 and 50 mm.

9. A dry end according to any one of claims 5 to 7, characterized by the fact that a stationary suction device is arranged within the loop of the preceding dryer group belt in the region of a point where the web runs off from the last cylinder of the preceding dryer group.

10. A dry end according to claim 9, characterized by the fact that, directly behind the point where the web runs off from the last cylinder of the preceding dryer group, there is provided a narrow scraper which serves to detach the tip of the transfer edge strip.

11. A dry end according to claim 1, characterized by the following features:

a) the drying cylinders are arranged essentially in horizontal rows; and b) the row of cylinders coming into contact with the bottom of the web is arranged at a difference in height H above the row of cylinders coming into contact with the top of the web.

12. A dry end according to claim 11, characterized by the fact that the difference in height H is 80 to 120% of a cylinder diameter D.

13. A dry end according to claim 1, characterized by the fact that the two dryer groups are arranged in the end region of the dry end and that the following dryer group can be driven at a lower speed than the preceding dryer group.

14. A dry end according to claim 1, wherein the web wraps around the transfer roll over an angle of between 10° and 50°.

15. A dry end according to claim 1, wherein the web wraps around the transfer roll over an angle (c) of at most 30°.

16. A dry end according to claim 1, characterized by the fact that a plane (E) which is defined by axes of the adjacent last cylinder of the preceding dryer group and a first cylinder of the following dryer group intersects the transfer roll.

17. A dry end according to claim 1, characterized by the fact that a clear distance (A) between a last drying cylinder of the preceding dryer group and a first drying cylinder of the following dryer group is between about 40 and 70% of a diameter (D) of one of said cylinders.

18. A dry end according to claim 17, wherein said clear distance (A) is between about 45 and 55% of said diameter (D).

19. A dry end according to claim 1, characterized by the fact that the clear distance (A) is at most 40% greater than the diameter (d) of the transfer roll.

20. A dry end according to claim 1, wherein a belt guide roll guiding the support belt of the preceding dryer group is positioned in close proximity to both the transfer roll and the first cylinder of the following dryer group.

21. A dry end according to claim 20, wherein said belt guide roll is supported in shiftable bearings such that said belt, downstream of the last cylinder, may travel:

a) either together with the web onto transfer roll and from there to said belt guide roll;

b) or on a path diverging from the web path, directly onto said belt guide roll.

22. A dry end of a machine for the manufacture of a fiber web, in particular a paper web, having the following features:

a) the dry end comprises a first plurality of heatable drying cylinders which form a preceding dryer group and rotate in one direction of rotation, and a second plurality of heatable drying cylinders which form a following dryer group and rotate in another direction of rotation, a reversing roll being arranged between every two drying cylinders;

b) the preceding dryer group has a first porous endless support belt forming a loop, and the following dryer group has a second porous endless support belt forming a loop, and the fiber web travels in each dryer group together with the respective support belt alternately over the drying cylinders and the reversing rolls so that the fiber web comes into direct contact with the drying cylinders, and the support belt comes into direct contact with the reversing rolls;

c) in the preceding dryer group, first side of the web comes into contact with the cylinders and a second side of the web comes into contact with the support belt;

d) in the following dryer group, which immediately follows the preceding dryer group, the second side of the web comes into contact with the drying cylinders and the first side of the web with the support belt;

e) between the two dryer groups there is a transfer roll lying within the loop of the second support belt and guiding the same; and f) the web travels from a last cylinder of the preceding dryer group to the transfer roll and wraps around the transfer roll over an angle of at most 90°;

g) the transfer roll has a shell which is provided with openings selected from the group consisting of circumferential grooves, blind holes, and continuous holes;

h) the web follows an at least approximately straight path of travel from the last cylinder to the transfer roll; and i) a guide roll lying within the loop of the first support belt of the first dryer group contacts said path of travel of the web, with a free (unsupported) web draw extending between and being tangential to the guide roll and the transfer roll.

23. A dry end according to claim 22, wherein the belt guide roll has a smooth roll shell surface.

24. A dry end of a machine for the manufacture of a fiber web, in particular a paper web, having the following features:

a) the dry end comprises a first plurality of heatable drying cylinders which form a preceding dryer group and rotate in one direction of rotation, and a second plurality of heatable drying cylinders which form a following dryer group and rotate in another direction of rotation, a reversing roll being arranged between every two drying cylinders;

b) the preceding dryer group has a first porous endless support belt forming a loop, and the following dryer group has a second porous endless support belt forming a loop, and the fiber web travels in each dryer group together with the respective support belt alternately over the drying cylinders and the reversing rolls so that the fiber web comes into direct contact with the drying cylinders, and the support belt comes into direct contact with the reversing rolls;

c) in the preceding dryer group, a first side of the web comes into contact with the cylinders and a second side of the web comes into contact with the first porous endless support belt;

d) in the following dryer group, which immediately follows the preceding dryer group, the second side of the web comes into contact with the drying cylinders and the first side of the web with the second porous endless support belt;

e) between the two dryer groups there is a transfer roll lying within the loop of the second support belt and guiding the same; and f) the web travels from the first to the second support belt on a free unsupported web draw terminating at the circumference of the transfer roll; and g) the web wraps around the transfer roll over an angle of at most 90° and travels together with the second belt on a straight path from the transfer roll to a first cylinder of the following dryer group; and characterized by the fact that the web follows a straight path of travel from a last cylinder of the preceding dryer group to the transfer roll.

25. A dry end of a machine for the manufacture of a fiber web, in particular a paper web, having the following features:

a) the dry end comprises a first plurality of heatable drying cylinders which form a preceding dryer group and rotate in one direction of rotation, and a second plurality of heatable drying cylinders which form a following dryer group and rotate in another direction of rotation, a reversing roll being arranged between every two drying cylinders;

b) the preceding dryer group has a first porous endless support belt forming a loop, and the following dryer group has a second porous endless support belt forming a loop, and the fiber web travels in each dryer group together with the respective support belt alternately over the drying cylinders and the reversing rolls so that the fiber web comes into direct contact with the drying cylinders, and the support belt comes into direct contact with the reversing rolls;

c) in the preceding dryer group, a first side of the web comes into contact with the cylinders and a second side of the web comes into contact with the first porous endless support belt;

d) in the following dryer group, which immediately follows the preceding dryer group, the second side of the web comes into contact with the drying cylinders and the first side of the web with the second porous endless support belt;

e) between the two dryer groups there is a transfer roll lying within the loop of the second support belt and guiding the same; and f) the web travels from the first to the second support belt on a free unsupported web draw terminating at the circumference of the transfer roll; and g) the web wraps around the transfer roll over an angle of at most 90° and travels together with the second belt on a straight path from the transfer roll to a first cylinder of the following dryer group;

characterized by the fact that the web follows a straight path of travel from a last cylinder of the preceding dryer group to the transfer roll; and characterized by the fact that the transfer roll is a suction roll.

26. A dry end according to claims 24 or 25, wherein the support belt of the preceding dryer group travels over a straight path, which diverges from the web travel path, from the last cylinder to a belt guide roll arranged in the loop of said support belt.

27. A dry end according to claim 26, wherein a diverging angle between the straight path of the support belt and the straight path of the web is between 2° and 30°.

* * * * *